United States Patent [19]

Jessup et al.

[11] 4,440,428

[45] Apr. 3, 1984

[54] APPARATUS FOR DELAYING THE CLOSING OF A DOOR

[76] Inventors: Frank L. Jessup, 1023 Eastlawn Dr., New Whiteland, Ind. 46184; Robert S. Kaiser, 11 McDonald Rd., Malboro, N.J. 07746

[21] Appl. No.: 298,498

[22] Filed: Sep. 1, 1981

[51] Int. Cl.[3] ..... E05C 17/56

[52] U.S. Cl. ..... 292/251.5

[58] Field of Search ..... 292/251.5; 49/29, 30, 49/13, 14

[56] References Cited

U.S. PATENT DOCUMENTS

| | | | |
|---|---|---|---|
| 2,472,397 | 6/1949 | Bennett | 292/251.5 |
| 3,431,002 | 3/1969 | Melgaard | 292/251.5 |
| 3,913,958 | 10/1975 | Larime | 292/251.5 |
| 4,257,631 | 3/1981 | Logan, Jr. | 292/251.5 |

FOREIGN PATENT DOCUMENTS

| | | | |
|---|---|---|---|
| 7802433 | 9/1979 | Netherlands | 292/251.5 |

*Primary Examiner*—Richard E. Moore
*Attorney, Agent, or Firm*—George A. Gust

[57] ABSTRACT

This invention relates to apparatus for holding swing or slide type doors open for a controlled period of time and includes in combination a door movable between a closed first position and a fully open second position. A holding device is mounted on a stationary support in such position as to be engaged by the door when moved to its second position, this device including an electromagnet and an actuating switch so disposed as to be engaged by the door when moved to its second position. Circuitry is provided between the switch and the magnet such that upon engagement of the door with the switch, the electromagnet is energized providing a magnetic force holding the door thereagainst. The circuitry further includes time delay means for deenergizing the electromagnet and for releasing the door after a predetermined period of time.

Included within the holding device is an alarm also connected into the circuitry which is energized a predetermined period of time before the aforementioned release thereby to provide an indication of impending door closing.

6 Claims, 4 Drawing Figures

APPARATUS FOR DELAYING THE CLOSING OF A DOOR

BACKGROUND OF THE INVENTION

1. Field of the Invention

The present invention relates to door controls and more particularly to a control for holding a door open for a predetermined period of time.

2. Description of the Prior Art

Manually operated doors for commercial buildings conventionally employ closure devices which return the door to closed position after the traffic has passed therethrough. The same type of operation is conventional for power operated doors which in some cases employ return springs for closing a door after traffic has cleared.

Since such doors are normally closed and are yieldably retained in such position, to hold the door open requires that the person passing therethrough do this manually. To accommodate passage of personnel with hand carts and material handling vehicles, it is usually necessary for the door either to be propped open, another person to hold it until the doorway is cleared, or the door be equipped with a fully automatic powered system. The fully automatic, powered system is often cost prohibitive to the door owner. This invention offers an alternative in the form of a semi-automatic door. This door-holding operation involves an element of inconvenience and attendant expense in the form of personnel time which this present invention seeks to avoid.

SUMMARY OF THE INVENTION

The present invention relates to an apparatus for holding a door open for a controlled period of time and includes in combination a door movable between a closed first position and a fully open second position. Means are provided for holding the door in the second position in response to movement thereto for a predetermined period of time following which the door is released from its second, open position. Means are also provided which are responsive to movement of the door to the second fully opened position for actutating the door-holding means whereby the door is held open for said predetermined period of time.

In one form, hold-actuating means includes an electrical switch disposed to be operatively engaged and operated when the door is moved manually to its fully open position thereby to actuate the holding means. The holding means may include a time-delay electromagnet disposed to be operatively engaged and to hold the door open when moved to its fully open position for the predetermined time. In a further arrangement, means are included within the aforementioned apparatus for providing a signal or alarm a predetermined period of time prior to the release of the door from the electromagnet.

It is an object of this invention to provide a control for holding a door open for a predetermined period of time. It is a further object to provide in combination with such control an alarm which will be energized a predetermined period of time prior to door closure.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
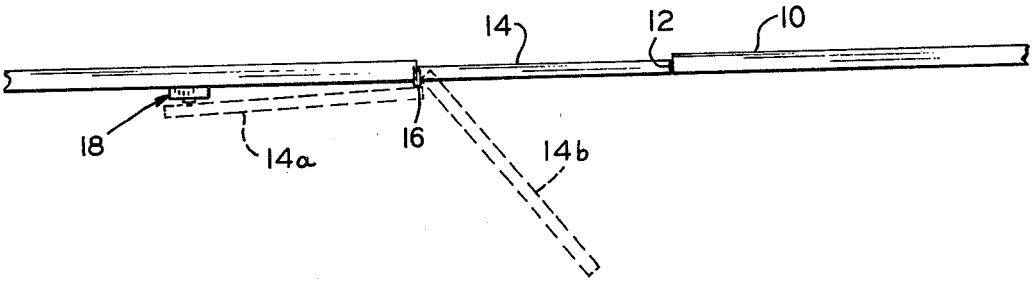
FIG. 1 is a top view in diagrammatic form of one embodiment of this invention and showing a door as being movable between closed and opened positions.

Referring to the drawings, FIG. 1 illustrates a conventional wall 10 having a door opening 12 which is normally closed by means of a door 14 hinged along one edge 16. The door 14 may be considered as a conventional swinging door which is yieldably held in closed position and may employ a suitable spring device (not shown) for holding it closed. The door 14 is swingable to various positions between fully closed as shown to fully open as indicated by the numeral 14*a* as well as to intermediate positions as indicated by the numeral 14*b*.

Mounted on the wall 10 or on a suitable mounting bracket (not shown) in position to be engaged by the door 14 is a door-holding device generally indicated by the numeral 18. The device 18 includes a suitable frame or cabinet having mounted therein a solenoid magnet 20 provided with a movable iron plunger 22. Disposed in line with the plunger 22 is a single pole single throw switch 24 held normally open by means of a compression spring 26. Upon movement of the plunger 22 toward the left as viewed in FIG. 3, the switch 24 may be closed. The solenoid 20 upon being energized magnetizes the plunger 22 in a conventional manner. The plunger 22 is so disposed with reference to the door 14 that it may be engaged thereby when moved to the position 14*a* thereby causing leftward movement (as viewed in FIG. 3) of plunger 22 against switch 24 causing it to close. Closure of the switch 24 by reason of interconnected circuitry as shown in FIG. 4 causes energization of the solenoid 20 thereby magnetizing the plunger 22. If the door 14 is of magnetic material or has a plate of magnetic material mounted thereon, engagement of the magnetized plunger 22 therewith will hold the door 14 in the position 14*a* until the solenoid 20 is deenergized. Since the door 14 is biased toward closing, plunger 22 is withdrawn from switch 24 permitting it to open. Upon deenergization, the plunger 22 releases the door whereupon the spring return moves the door to its closed position. Horizontally slidable doors function similar and can be controlled in essentially the same manner by this invention as swinging doors.

The device 18 further includes a manually operated switch 28 which upon being actuated to one position energizes the solenoid 20 permanently thereby to hold the door 14 open for an indefinite period of time. Upon operating the switch 28 oppositely, the door 14 is released.

It is desirable that a manually adjustable control be available for the purpose of determining the period of time the door 14 is held open. This is provided by means of control 30 on the front panel of the device 18 which is adjustable to vary the door-holding time. Also, in order to provide a warning of impending door closure, an electric lamp 32 and a buzzer 34 may be provided in the device 18 which are operable by means of the circuitry of FIG. 4 a short time just prior to release of the door by the solenoid 20. The lamp 32 may be physically separated from device 18 to be in plain view with the door either open or closed.

While the solenoid-switch assembly 20, 24 is shown as being contained within the cabinet of device 18, it should be understood that it alone may be contained in a suitable box separate and apart from the remainder of device 18. The box containing the assembly 20, 24 would then be mounted on wall 10 in place of device 18 and the latter would be mounted in a suitable location providing convenient access.

Referring to FIG. 4, the circuitry there disclosed is incorporated within the cabinet of the device 18. The switch 28 is of the single pole double throw type and has its movable are connected to one terminal of a source 84 of alternating current voltage, the other terminal of this source being grounded as shown. In the embodiment illustrated, this source is set to a value of twenty-four volts. One of the stator contacts 36 is connected to one side of the solenoid 20, the other side of the solenoid being grounded. Upon movement of the switch 28 to engage contact 36, a twenty-four volt circuit is established to the solenoid 20 causing it to be energized. Solenoid 20 will remain energized until the switch 28 is moved to the other contact 38 which represents the automatic operational mode of the system.

The contact 38 is connected by means of a line 40 to a half wave rectifier generally indicated by the numeral 42 which provides a DC voltage output at terminal 44 of a value of about −15 volts and a DC voltage output at terminal 45 of about −24 volts. This terminal 44 is connected to other terminals in the circuit carrying the same numeral but with a letter suffix.

The normally open switch 24 is coupled between ground and the inverting terminal of a differential operational amplifier 46. For this and the other operational amplifiers to be described, the non-inverting terminal will be referred to as the "plus" terminal and the inverting terminal as the "negative" terminal for purpose of convenience. Resistors R3, R4 and R6 are series connected between switch 24 and the "minus" terminal. A voltage divider R7 and R8 is connected to the "plus" terminal between source terminal **44*a* and ground. Also to the source terminal 44*a* is connected the divider network R1, R2 and R5 as shown. The output terminal 48 of operational amplifier 46 is connected by means of a resistor R11 and diode D2 to a main delay, charging capacitor C5, a discharging resistor R20 being connected in shunt with this capacitor. The output terminal 48 is also connected by means of a line 50, diode D4 and resistor R24 to the base element of a transistor Q2. The collector is connected by means of a diode D19 and a light emitting diode 52 as well as the resistor network R33, R34, R35, R36 and R37 to a 24 volt direct current supply line 54 which connects back to terminal 45. A resistor R38 also connects this same supply line 54** to the collector of transistor Q2 by means of a diode D7. A diode D6 connects from the cathode of the diode D7 to the charging capacitor C5, a resistor R27 being in series.

The terminal 56 of the capacitor C5 is connected to the "plus" terminal of the operational amplifier 58 and the "minus" terminal is connected to the movable arm of a variable resistor R18 (same as control 30) which is series connected with resistors R17 and R19 between supply terminal **44*c* and ground. The setting of this variable resistor R18 (control 30**) determines the period of time the system is energized for holding a door in open position.

The output terminal 60 of the operational amplifier 58 is connected to a voltage divider of two series connected resistors R21 and R22. The center tap of these two resistors is connected to the plus terminal of operational amplifier 62. A resistor R23 connects between source terminal **44*e* and the "minus" terminal of operational amplifier 62, this same "minus" terminal being connected by means of resistor R26 and diode D5 to the cathode of diode D7. The output terminal 64 of operational amplifier 62 is connected by means of a diode D3 to the resistor R24 and also to a capacitor C7 which is grounded as shown. The junction 66 of diodes D3, D4, resistor R24 and capacitor C7 is connected by means of a line 68 to a second charging capacitor C2 by means of a diode D9. This same line 68 is connected by means of a line 68*a* to the "minus" terminal of operational amplifier 70 by means of another diode D10, and this same minus terminal is connected to a variable voltage divider composed of resistors R14, R15 and R16 which are series connected between source terminal 44*f*** and ground. Resistor R15 determines the alarm duration and is made adjustable for the purpose.

A pair of resistors R12 and R13 are shunt connected across the capacitor C2 with the center tap thereof being connected to the "plus" terminal of the operational amplifier 70.

The output terminal 72 of operational amplifier 70 is connected to the base of transistor Q1 by means of a resistor R47. The collector of transistor Q1 is connected in series with a light emitting diode 74 and a network of resistors R28, R29, R30, R31 and R32 as shown to the supply line 54. Also, another line 76 leads from the collector element of transistor Q1 via the diode D8 to the light emitting diode 52 network as shown. Thus this same light emitting diode 52 can be energized by either or both the transistors Q1 and Q2 via their collectors.

The numeral 78 generally indicates a first conventional photon coupler having a light sensitive control device 80 therein. This device 80 is located in proximity to the light emitting diode 52 as indicated by the dashed line 82 such that light emitted by the diode 52 will irradiate device 80 thereby to apply AC voltage from the source terminals 38 to the solenoid 20, via triac Q3.

A similar photon coupler is generally indicated by the numeral 86 with the light-sensitive component 88 thereof being light coupled to the light emitting diode 74 as indicated by the dashed line 90. This photon coupler 86 has in series With the output circuit an electric lamp 32, this coupler 86 being supplied with voltage from 120 volts alternating current source terminals 92. The photon coupler 86 in the absence of light from the light emitting diode 74 is in an "open" condition whereupon the lamp 32 is not energized. Upon excitation of the light sensitive device 88, the triac Q4 closes a circuit thereby applying 120 volts alternating current across lamp 32 causing it to glow, thus providing visual indication of impending door closure.

For the purpose of providing an audible alarm, a conventional audio signaling device 34 is connected across the network of resistor R28, R29, R30, R31 and R32 as shown.

In operation, 24 volts alternating current is applied to terminals 84 and 120 volts alternating current to terminals 92. With the switch 28 thrown to the position 36, energizing voltage is directly applied to the solenoid 20 causing continued energization thereof. With the switch 28 thrown to the contact 38, a 24 volt source is applied to the direct current power supply 42 where it is rectified and converted to −15 volts DC at terminal 44 and −24 volts DC at terminal 45.

With reference to the operational amplifiers 46, 58, 62 and 70, these are used as combination voltage comparators and output switches. These operational amplifiers are powered from the −15 volt supply 44, and in the working embodiment disclosed, all such voltages are negative with respect to ground. In the following description, mention of "greater" voltage means that the voltage is more negative. For simplicity, the negative notation will be omitted in the remainder of this description.

Each operational amplifier has two input and one output circuits. The input circuits are conventionally referred to as inverting and non-inverting. As explained previously, the inverting terminal is marked with a "minus" (−) sign in the drawings and the non-inverting terminal is marked with a "plus" (+) in the drawings. If the non-inverting input exceeds the inverting in terms of applied voltage, the output circuit will deliver approximately −14 volts. If the inverting terminal exceeds the non-inverting terminal as to applied voltage, the output voltage will be at or near ground potential.

With the source voltages applied and the circuitry otherwise non-actuated, the voltage at the output terminal 48 of operational amplifier 46 is ground, the voltage on terminal 60 of operational amplifier 58 is high or at about −14 volts, the output voltage on terminal 64 of amplifier 62 is low or at ground potential and the transistor Q2 is normally cut-off. The output voltage on terminal 72 of operational amplifier 70 is at ground and the transistor Q1 is normally cut-off.

Still further with respect to idling conditions, since transistor Q2 is normally cut-off, the voltage on line 94 is at 15 volts as limited by zener diode Z3. Capacitor C5 is charged to 14 volts via diode D6 and resistor R27. The value of resistor R27 is chosen to provide 14 volts with the divider resistor R20 which serves to discharge capacitor C5. This capacitor C5 is the main time delay capacitor in the total circuitry, and is discharged over a period of time approximating one minute. The voltage at the capacitor C5 is applied to the "plus" terminal of operational amplifier 58. The "minus" terminal is supplied with an adjustable voltage from the network of resistors R17, R18 and R19. The value of voltage applied to this "minus" terminal is chosen to be slightly less than that applied to the "plus" terminal with resistor 18 adjusted to its extreme setting which represents minimum time delay of about one second, or the time required for capacitor C5 to discharge down to the voltage value established by resistor R18 on the "minus" terminal. For this set of voltages, operational amplifier 58 is delivering an output voltage to divider network composed of resistors R21 and R22. Since the output of operational amplifier 58 is divided by resistors R21 and R22, only about seven volts is applied to the terminal 12 of operational amplifier 62. Amplifier 62 is prevented from producing a voltage at its output terminal 64 due to the application of 15 volts on terminal 13 by means of resistor R23. The value of resistor R23 is about 10,000 ohms, and resistors R26 and diode D5 cannot reduce this voltage on terminal 13, because line 94 is at 15 volts. Thus it is illustrated that the time delay network is armed and ready for a start command.

The operational amplifier 46 is controlled by the normally open push button 24. The network of resistors R1 through R8 are for providing voltage division and protection against excessive currents through the contacts of the switch 24. The zener diode Z1 and capacitor C1 are for noise and radio frequency supression. The resistor R6 of 10,000 ohms serves to prevent damaging zener diode Z1 in the event that 24 volts might accidentally be applied to the input terminal of the switch 24. Resistors R7 and R8 form a divider that applies −3 volts to terminal 5 of operational amplifier 46 thereby causing the output at terminal 14 to be at ground potential. Upon closing the switch 24, output voltage momentarily occurs at output terminal 48 of operational amplifier 46 and is coupled to the base of transistor Q2 by means of diode D4 and resistor R24. Transistor Q2 now saturates and places line 94 near ground potential by means of conduction through diode D7. Terminal 13 of operational amplifier 62 is dropped to about 1.5 volts due to the value of resistor 26 being about 1,000 ohms. Now the voltage at terminal 60 of operational amplifier 58 is capable of being switched through operational amplifier 62 with the lowering of the voltage on pin 13 of operational amplifier 62 to about 1.5 volts. The applied voltage of about 7 volts from operational amplifier 60 on terminal 12 of operational amplifier 62 is now able to switch to a state of supplying high voltage to transistor Q2 as if operational amplifier 46 were itself supplying this voltage.

It should be noted that the voltage supplied at terminal 48 of operational amplifier 46 is only momentary and occurs only during momentary closure of the pushbutton 24. When the pushbutton 24 is released and the contacts thereof open, the voltage at terminal 48 drops to ground. With operational amplifier 62 now triggered into the state of providing a voltage of about 14 volts at output terminal 64, the transistor Q2 is rendered conductively saturated. Current flowing in the collector circuit of transistor Q2 energizes the light emitting diode 52, the resistor network therearound serving to limit current flow and to prevent unwanted trickle currents from false triggering the light emitting diode 52. This results in energizing the photon coupler 78 thereby energizing the solenoid via transistor Q3.

As long as the pushbutton switch 24 is held closed, the time delay capacitor C5 remains charged by means of resistors R11 and diode D2 from operational amplifier 46. Upon release of this pushbutton switch 24, capacitor C5 begins to discharge. At the end of the chosen delay period, as determined by the setting of variable resistor R18, operational amplifier 58 will provide no output voltage, correspondingly operational amplifier 62 will provide no output voltage and transistor Q2 will be at cut-off, allowing gating network composed of resistors R23 and R26 and diode D5 to reestablish the output voltage of operational amplifier 62 to ground level. At the moment line 94 is at 15 volts and recharges capacitor C5, thus rearming the circuitry for another operation of switch 24.

Recapitulating, momentary closing and opening of switch 24 results in producing a pulse of voltage at terminal 48 of operational amplifier 46. This pulse of voltage renders transistor Q2 fully conductive thereby lowering the voltage on line 94 to near zero. This voltage on line 94 changes the states of operational amplifiers 58 and 62 and results in a latching voltage being applied at the output terminal 64 which retains transistor Q2 in conductive state. This latching will continue until the capacitor C5 discharges to a level of voltage as determined by the setting of the resistor R18 (control 30), at which time the operational amplifiers 58 and 62 change states again thereby withdrawing the drive voltage from the base of transistor Q2 thereby causing the latter to return to cut-off condition. At this moment, voltage on line 94 raises to the 15 volt level as previously explained.

Now continuing with the circuit operation, it should be noted that while the transistor Q2 is conductive, simultaneously capacitor C2 is charged to 14 volts by means of diode D9 from terminal 66. Resistors R12 and R13 are chosen to provide a division of capacitor C2's voltage of about 12 volts. The series string of the two resistors provides the discharge path for capacitor C2. This division is necessary to allow the 14 volts present at line 68 to apply 14 volts at terminal 2 of operational amplifier 70 by means of diode D10. Under these conditions, there is no output voltage at the terminal 72 of operational amplifier 70, but the network is armed, this network including capacitor C2, resistors R12, R13, R14, R15, R16 and R17. Resistor R15 is used to determine the duration of discharge of the capacitor C2 and therefore determines the alarm duration. Resistor R17 prevents the line 68 from being swamped by the values of resistors R15 and R16.

At the conclusion of the discharge of the main delay capacitor C5 as determined by the setting of the variable resistor R18, voltage at terminal 66 will drop to ground level, and operational amplifier 70 is no longer inhibited by means of diode D10 from the line 68 and capacitor C2 is now able to dominate operational amplifier 70. Operational amplifier 70 now being triggered into a state of high output voltage at terminal 72 drives transistor Q1 into saturation by means of resistor 47. Since the collector of transistor Q1 is connected in parallel with the collector of transistor Q2 by means of line 76, light emitting diode 52 will remain energized even though transistor Q2 has cut off. This results in photon coupler 78 remaining energized as well as solenoid 20. Simultaneously, the collector current in transistor Q1 also passes through the diode and resistance network which includes light emitting diode 74. The audio signaling device or buzzer 34 is now energized and sounds a warning signaling the end of conductivity of the transistor Q2 and the beginning of conductivity of the transistor Q1, these events being controlled by the discharging of capacitors C5 and C2, respectively.

Also, by reason of the energization of the light emitting diode 74, photon coupler 86 is energized thereby turning on the lamp 32. With this lamp colored red, a visible warning is given which coincides with the audible warning given by the device 34.

When the capacitor C2 fully discharges to the setting as determined by the variable resistor R15, and preferably this corresponds to an adjustable time period of from one to four seconds, operational amplifier 70 changes state to a condition at which the output voltage on terminal 1 drops to ground level, causing transistor Q1 to cut off. This releases both photon couplers 78 and 86 allowing all loads, 20, 32 and 34 to be deenergized.

In this operation, the warning devices 32 and 34 are energized during the last portion of the energization of the solenoid 20 regardless of the delay setting of the variable resistor R18.

With respect to controlling the closing of the door 14 of FIG. 1, regardless of the setting of the control 30, the alarm devices 32 and 34 will sound at a time of from one to four seconds just prior to door closing, this latter time being determined by the setting of resistor R15.

The foregoing system may also be combined with a conventional burglar, fire or similar alarm having normally closed switch 31 in series with solenoid 20. This switch 31 when opened removes all energizing voltage from solenoid 22. Therefore, if solenoid 22 is energized and is holding a door open, whether switch 28 be in either of its positions 36 or 38, actuation of the burglar, etc., alarm opens switch 31. Solenoid 20 thereupon releases the door and it immediately closes, the release condition continuing so long as the alarm remains actuated, it being desirable to close all doors in the event of fire or burglary.

Figure 2:
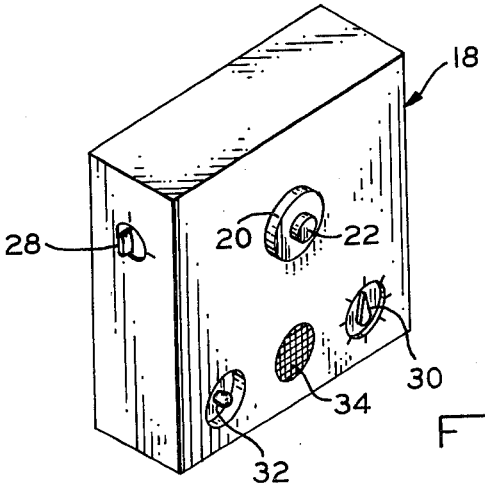
FIG. 2 is a perspective view of one embodiment of a holding device of this invention used for controllably maintaining the door in open position.
Figure 3:
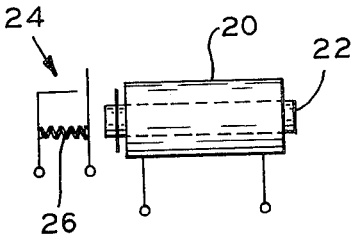
FIG. 3 is a side view in diagrammatic form of a combination solenoid and actuating switch employed in the device of FIG. 2.
Figure 4:
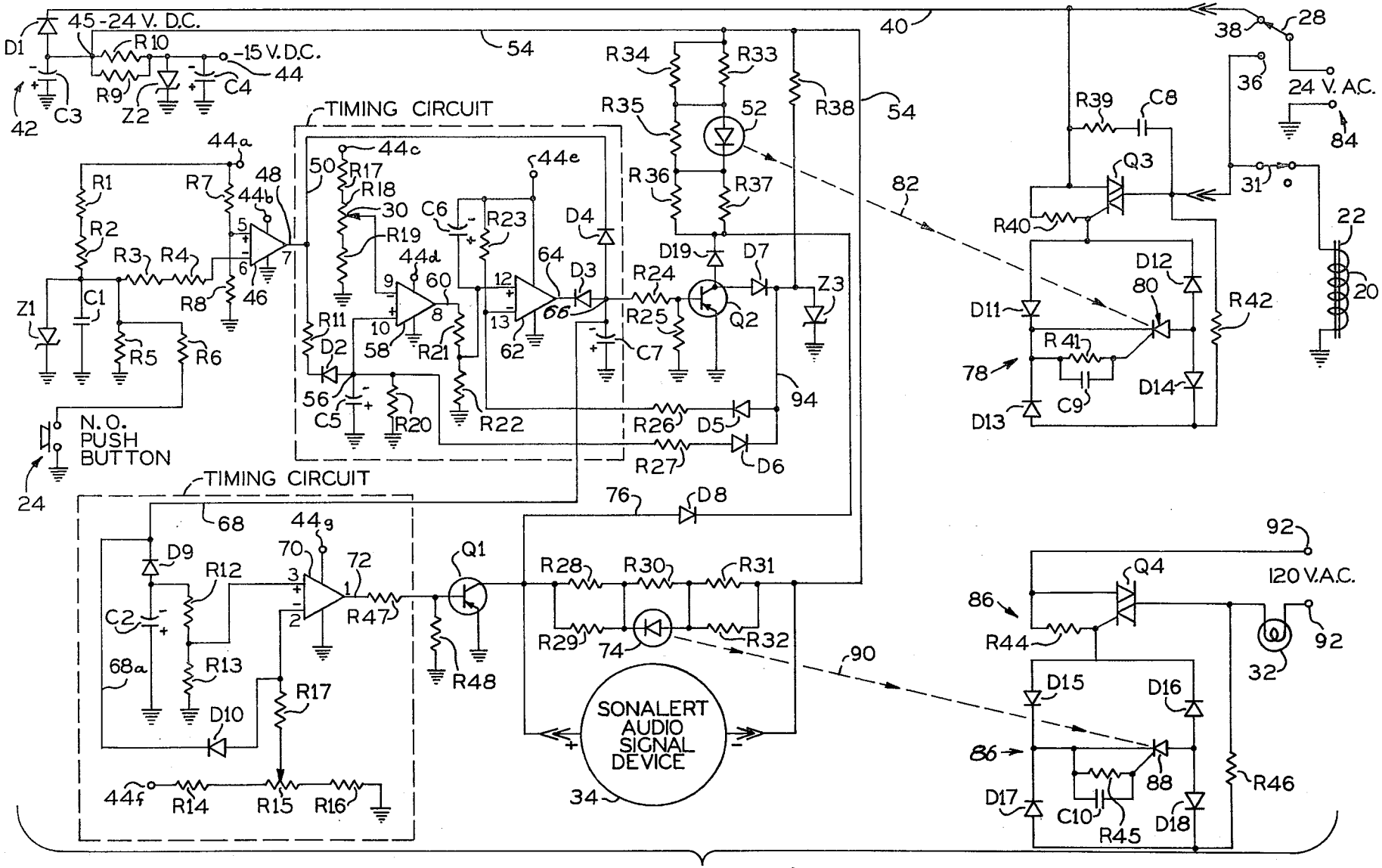
FIG. 4 is a diagram of the electronic circuitry employed within the device of FIG. 2.

Referring to FIGS. 1 to 3, it will now be seen that upon opening the door 14 to the position **14*a* bringing the door into engagement with the plunger of solenoid 22, the contacts of switch 24 will be momentarily closed thereby resulting in energization of the solenoid 20. This magnetizes the plunger 22 holding the door 14 open. Upon expiration of the time period as set by the control 30 (resistor R18), the solenoid 20 is deenergized thereby resulting in release of door 14 to permit it to close. The warning devices 32 and 34 provide an alarm just prior to door closing thereby warning personnel to stand clear. If it is desired to prolong the period of door opening, it is only necessary to push the door 14 against the plunger 22 with sufficient force to recycle the switch 24**.

In the following is listed the values of the components in a working embodiment of this invention, it being understood that these are exemplary only and are not limitative of the invention.

| | |
|---|---|
| R1, R2, R3, R4 | 300,000 OHM |
| R5, R13 | 430,000 OHM |
| R6, R8, R11, R16, R23, R27 | 10,000 OHM |
| R7 | 56,000 OHM |
| R9, R10 | 1000 ½ W |
| R12, R41, R45 | 100,000 OHM |
| R14, R24, R27 | 3300 OHM |
| R15, R18 | 10K POT |
| R17 | 2200 OHM |
| R19, R26, R28, R29, R30, R31, R32, R33, R34, R35, R36, R37 | 1000 OHM |
| R20 | 750,000 OHM |
| R21, R22 | 30,000 OHM |
| R25, R48 | 510 OHM |
| R38 | 4700 OHM |
| R39, R42, R46 | 100 OHM |
| R40, R44 | 16 OHM |
| R43 | 25W LAMP |
| D1 | MR-504 Motorola |
| D ALL | PTC-205 Mallory |
| C1, C8 | 0.1 MFD 250V |
| C2, C6, C7 | 10 MFD 16VDC |
| C3, C4 | 100 MFD 50VDC |
| C5 | 22 MFD 16VDC |
| Z1 | 1N5236B |
| Z all but Z1 | 1N4744 |
| Q1, Q2 | 2N4403 |
| Q3, Q4 | Q4015L5 |
| 46, 58, 62, 70 | LM324NA+ |
| Photon Couplers 78, 86 | 4N40 |

While there have been described above the principles of this invention in connection with specific apparatus, it is to be clearly understood that this description is made only by way of example and not as a limitation to the scope of the invention.

What is claimed is:

1. Apparatus for holding a normally closed door open for a controlled period of time comprising in combination with a door movable between a closed first position and an open second position with the door normally biased toward the closed position, means for holding said door in said second position, means responsive to manual movement of said door to said second position for actuating said holding means, timing means also responsive to manual movement of said door to said second position for initiating timing of the controlled period and at the expiration of the controlled period of time to disable the means for holding so that the door is released for movement to its first position.

2. The apparatus of claim 1 wherein said actuating means includes an electrical switch disposed to be operatively engaged and closed when said door is moved to its second position.

3. The apparatus of claim 2 wherein said holding means includes an electro-magnet disposed to be operatively engaged and to hold said door open when moved to its second position for said controlled period of time.

4. The apparatus of claim 3 wherein said holding means further includes a signalling means for providing an alarm a second predetermined period of time prior to the termination of said first-mentioned controlled period of time.

5. The apparatus of claim 4 wherein said holding and signalling means includes means for energizing said signalling means without interrupting the holding of the door by said holding means.

6. The apparatus of claim 1 including means for disabling said holding means in response to the actuation of a burglar, fire or the like alarm.

* * * * *